US006186482B1

(12) United States Patent
Nomura

(10) Patent No.: US 6,186,482 B1
(45) Date of Patent: Feb. 13, 2001

(54) CARBURETOR CHOKE VALVE

(75) Inventor: Yoshimasa Nomura, Wako (JP)

(73) Assignee: Honda Giken Kogyo Kabushiki Kaisha, Tokyo (JP)

( * ) Notice: Under 35 U.S.C. 154(b), the term of this patent shall be extended for 0 days.

(21) Appl. No.: 09/159,755

(22) Filed: Sep. 24, 1998

(30) Foreign Application Priority Data

Sep. 25, 1997 (JP) ..... 9-259544

(51) Int. Cl.[7] ..... F02M 1/02

(52) U.S. Cl. ..... 261/43; 261/46; 261/55; 261/63

(58) Field of Search ..... 261/43, 45, 46, 261/54, 55, 63, 39.1, 39.3, 39.5, 39.4

(56) References Cited

U.S. PATENT DOCUMENTS 1,894,354 * 1/1933 Kommer et al. ..... 261/54
2,062,260 * 11/1936 Weber ..... 261/39.3
2,108,296 * 2/1938 Roualet ..... 261/39.3 X
2,263,027 * 11/1941 Beard ..... 261/39.3
2,421,733 * 6/1947 Henning ..... 261/39.3
2,457,570 * 12/1948 Leibing ..... 261/39.3
2,571,181 * 10/1951 Ball ..... 261/39.3 X
4,770,823 * 9/1988 Sejimo ..... 261/39.3 X
5,688,443 * 11/1997 Swanson ..... 261/39.3

FOREIGN PATENT DOCUMENTS 58-165555 9/1983 (JP) .

* cited by examiner

*Primary Examiner*—Richard L. Chiesa
(74) *Attorney, Agent, or Firm*—Birch, Stewart, Kolasch & Birch, LLP

(57) ABSTRACT

To provide a lightweight choke valve that has a reduced number of components and is easy to assemble, despite being provided with a relief valve. A carburetor choke valve provided in an intake passageway of a carburetor includes a plate shaped choke valve body having a relief opening. A base end side of a plate shaped relief valve for opening and closing the relief opening is jointly fastened to a rotatably supported choke shaft crossing the intake passage of the carburetor.

21 Claims, 10 Drawing Sheets

CARBURETOR CHOKE VALVE

BACKGROUND OF THE INVENTION

1. Field of the invention

The present invention relates to a choke valve provided with a carburetor, and particularly to a choke valve provided with a relief valve in the choke valve body of the carburetor.

2. Description of Related Art

A conventional example of such a choke valve provided with a relief valve is disclosed in Japanese Patent Laid-open No. Sho. 58-165555, and is shown in FIG. 14 of the present invention.

A throttle valve 04 is arranged at a downstream side of a venturi section 03 in an intake passageway 02 of the carburetor body 01. A choke valve 05 is arranged at the upstream side of the venturi section 03.

The choke valve 05 is attached with screws to a choke shaft 06 that is rotatably constructed in the intake passageway 02.

A relief window 05*a* is formed through the choke valve 05. This relief window 05*a* opens and closes the relief valve 08.

The relief valve 08 is formed as an elastic plate, and a base end part is attached to the choke valve 05 using screws 09 etc. The relief window 05*a* is closed when the relief valve is not subject to any external force.

In the relief valve 08 provided in the above described choke valve 05, a base end part is attached to the choke valve 05 using screws 09 etc. which avoid the choke shaft 06. Therefore, the screws 07 for attaching the choke valve 05 to the choke shaft 06 are necessary, as well as a separate attachment member such as screws 09 for attaching the relief valve 08 to the choke valve 05. Therefore, there are a large number of manufacturing steps and the number of components is increased. Accordingly, the manufacturing cost is increased.

In addition, because of the large number of components, the overall weight of the choke valve 04 having a relief valve attached thereto is heavy.

If the choke valve 04 is heavy, it can not operate smoothly. As a result, the choke valve 04 crashes into a seat surface when it is completely closed, leading to abrasion of the seat surface.

Furthermore, because the base end side of the relief valve 08 is attached to the choke valve 05 using screws 09 etc. such that the choke shaft 06 is avoided, the relief window 05*a* can not be located close to the choke shaft 06 which is the rotational axis of the choke valve 05. Therefore, the relief passageway can not be kept wide.

SUMMARY OF THE INVENTION

In view of the above described problems, the object of the present invention is to provide a choke valve with an excellent relief function, without the necessity of a relief valve. Therefore, the choke valve has a reduced number of components, is easy to assemble, and is light in weight.

In order to achieve the above objects, the present invention provides a carburetor choke valve provided in an intake passageway of a carburetor, comprising a plate shaped choke valve body having a relief opening. A base end side of a plate shaped relief valve for opening and closing the relief opening, is jointly fastened to a rotatably supported choke shaft crossing the intake passage of the carburetor.

The choke valve body and the relief valve are fastened together to the choke shaft. Therefore, the number of components is reduced, the number of assembly steps is reduced and manufacture is simplified.

Other than the screws needed to fasten the elements together, there is no need for an attachment member etc. Therefore, the choke shaft can be made lightweight in structure, the smooth operation of the choke valve can be accomplished, oscillation inertia can be reduced and abrasion of the seat surface when the valve is completely open can be restricted.

In addition, the base end side of the relief valve is attached to the choke shaft together with the choke valve body. Therefore, the relief opening can be made close to the choke shaft which is the rotational axis of the choke valve. As a result the relief passageway can be made wide and the relief function can be improved.

According to the present invention, the relief valve comprises a free end side valve body hinged to a base end side plate section together with a hinge structure energized in one rotational direction by a relief spring. The relief valve is jointly fastened to the choke shaft by pinching the choke valve body with the base edge sideplate section of the relief valve.

The relief valve itself has a hinge structure, and is attached to the choke shaft by the base end sideplate section pinching the choke valve body. Therefore, the number of assembly steps is reduced and manufacture is simplified.

According to another aspect of the present invention, both ends of the relief spring are extended along by a torsion coil spring.

When there is vibration of the free end side valve body relative to the base end sideplate section of the relief valve, the two ends of the relief spring respectively extend along the base end sideplate section of the relief valve and the surface of the free end side valve body. Therefore, the contact area is not impaired, giving abrasion protection.

According to a further aspect of the present invention, the relief valve is an elastic plate member which is fastened together with the choke shaft by pinching the choke valve body with an end section of a base end of the relief valve.

Because the relief valve is composed of only an elastic plate member and is attached to the choke shaft together with the choke valve body, the number of components and the number of assembly steps are reduced, and assembly is simplified. In addition, the choke valve body is made lighter in weight and has an extremely smooth operation, and abrasion resistance of a seat surface is improved.

According to a further aspect of the present invention, a carburetor choke valve is provided in an intake passage of a carburetor. The choke valve has a relief valve for opening and closing relief openings that have been formed in the choke valve body. The relief valve includes a free end side valve body hinged to a base end sideplate section together with a hinge structure energized in one rotational direction by a relief spring. Furthermore, the base end sideplate section of the relief valve is attached to the choke valve or a choke shaft.

By forming the hinge structure of the relief valve in advance, the number of assembly steps for the choke valve is decreased, and assembly can be simplified.

Further scope of applicability of the present invention will become apparent from the detailed description given hereinafter. However,it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DESCRIPTION OF THE PREFERRED EMBODIMENTS

An embodiment of the present invention will now be described below with reference to FIGS. 1–10.

Figure 1:
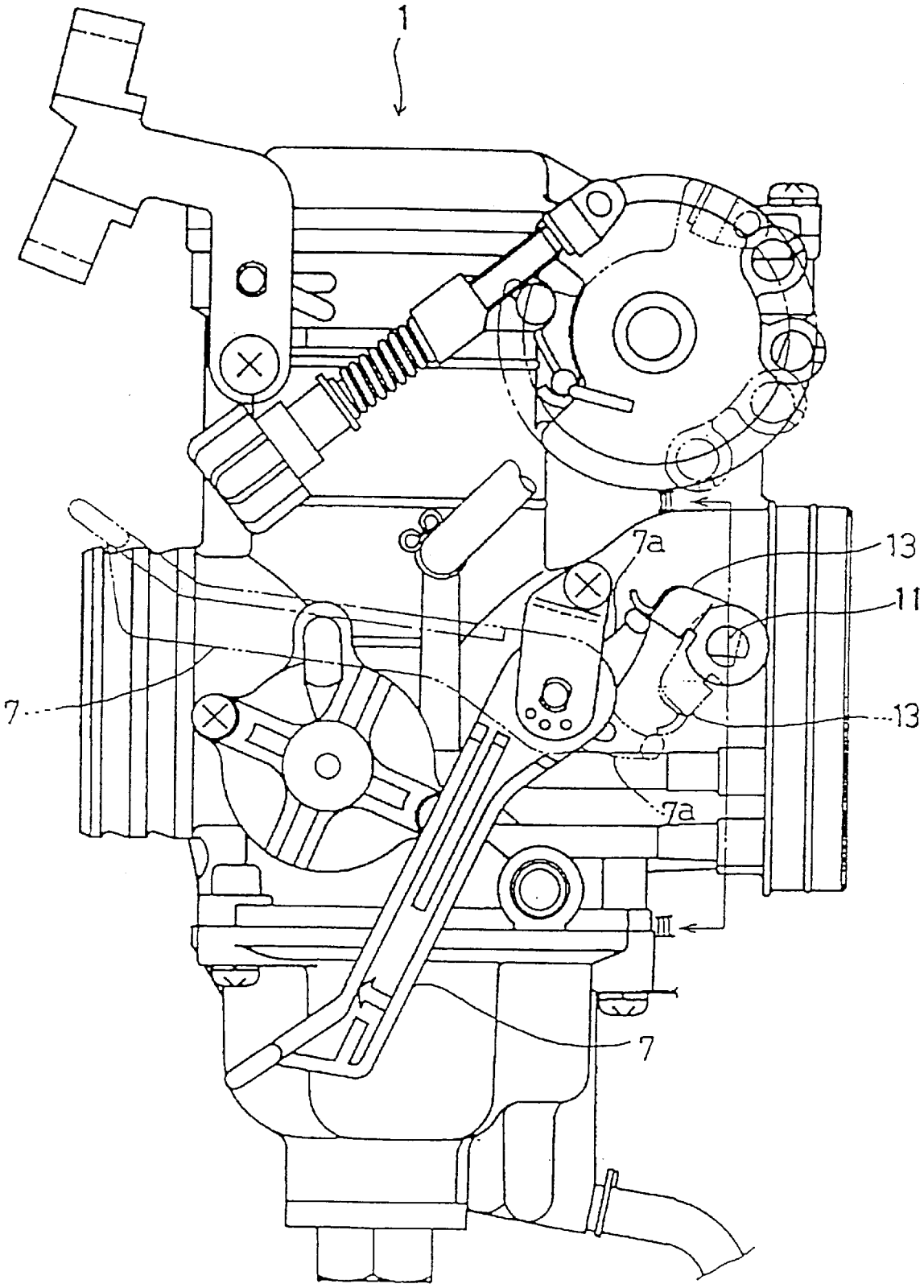
FIG. 1 is a side elevation of a carburetor to which one embodiment of the present invention relates.
Figure 2:
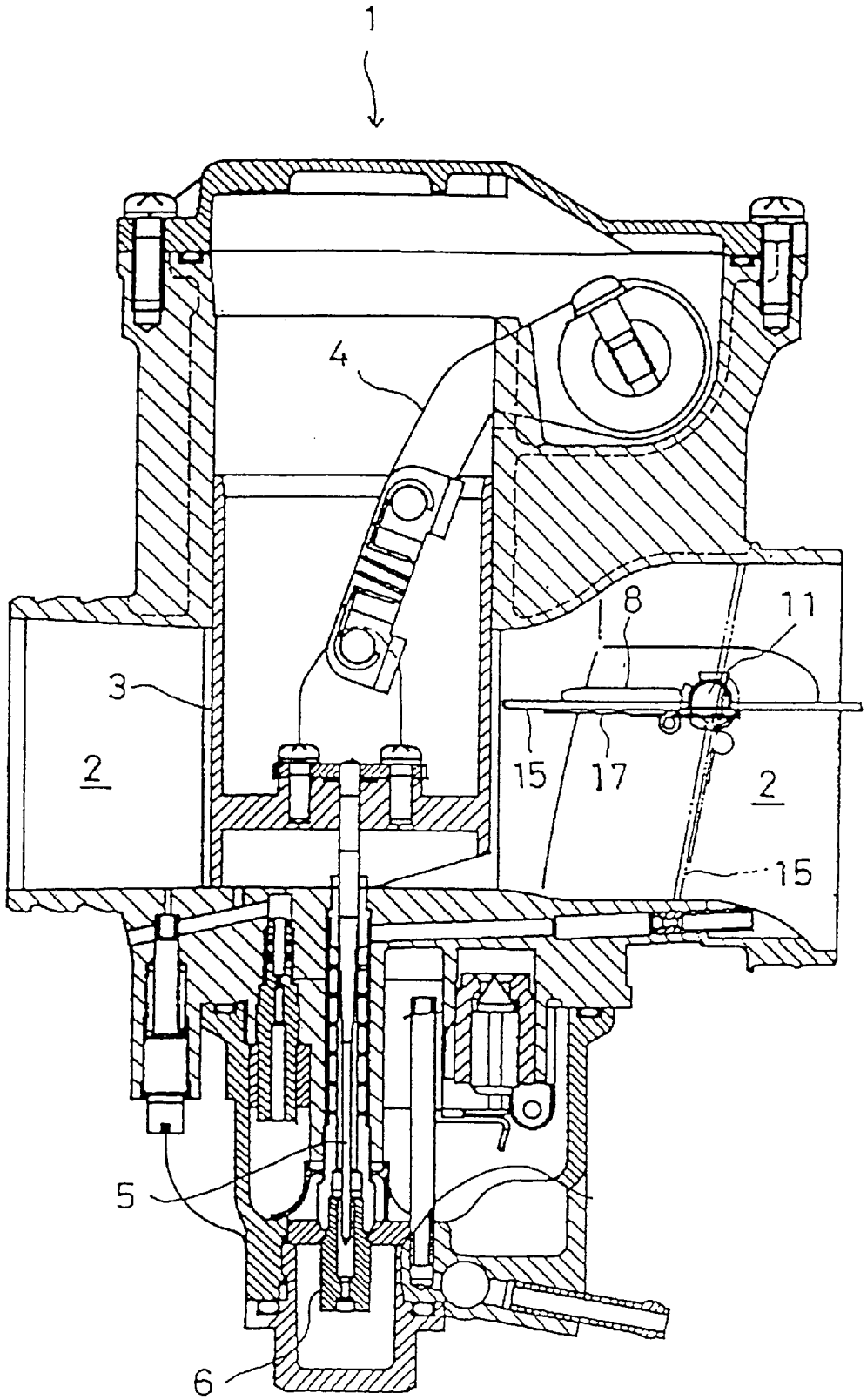
FIG. 2 is a cross sectional drawing of the carburetor to which one embodiment of the present invention relates.

A side view of a carburetor 1 having a choke valve 10 of this embodiment is shown in FIG. 1, while a cross section is shown in FIG. 2.

The venturi surface is varied by raising a throttle valve 3 protruding into the inlet passageway 2 of the carburetor 1 using a throttle lever 4. Fuel is supplied from a main jet 6 into which a jet needle 5 protruding downward from the throttle valve 3 is inserted.

The choke valve 10 is provided in the inlet passageway 2 upstream of the throttle valve 3.

A pair of bearing boss sections 2*a*, 2*a* jut out in opposite directions from the upstream side inlet path 2 of the carburetor 1. A choke shaft 11 having both ends rotatably supported by the bearing boss sections 2*a*, 2*a* is constructed crossing the inlet passageway 2 (refer to FIG. 3).

Figure 3:
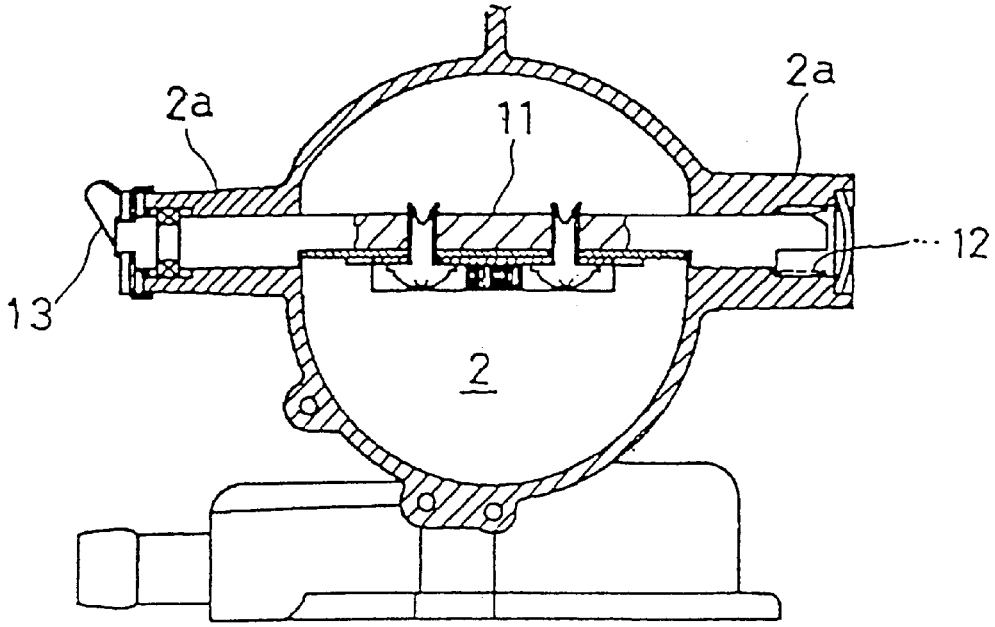
FIG. 3 is a cross sectional drawing taken along line III—III in FIG. 1.

As shown in FIG. 3, a torsion coil spring 12 is wound around inside the bearing boss section 2*a* at one end of the choke shaft, and the torsion coil spring urges the choke shaft in a rotational direction.

The other end of the choke shaft 11 protrudes from the bearing boss 2*a* and engages with a choke lever 13.

Referring to FIG. 1, an operating lever 7 that is hinged to a base end section is provided at a side wall of the carburetor 1 so as to be swingable along the side wall. A protrusion 7*a* formed at a base end side of this operating lever 7 abuts against the choke lever 13.

The choke lever 13 integral with the choke shaft 11 is urged in a direction to abut against the protrusion 7*a* of the operating lever 7 by the torsion coil spring 12.

Accordingly, if the operating lever 7 is swung upwards from the state shown by solid lines in FIG. 1, the choke lever 13 swings downwards while contacting the protuberance 7*a* due to the torsion coil spring 12, and the choke shaft 11 rotates (refer to the two-dot dashed lines in FIG. 1 and FIG. 2).

Figure 7:
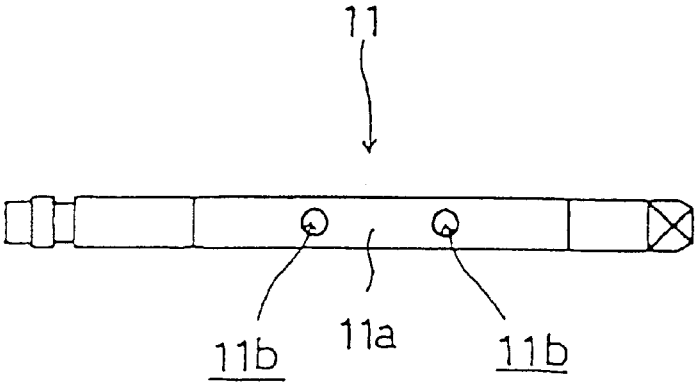
FIG. 7 is a front elevation of a choke shaft.

The choke shaft 11 has a flattened part 11*a* formed by cutting or milling away the middle corresponding to the width of the intake passageway 2, and pair of screw holes 11*b*, 11*b* are drilled in this flattened part 11*a* (refer to FIG. 3 and FIG. 7). The choke valve body 15 is attached to this flattened part 11*a*.

Figure 8:
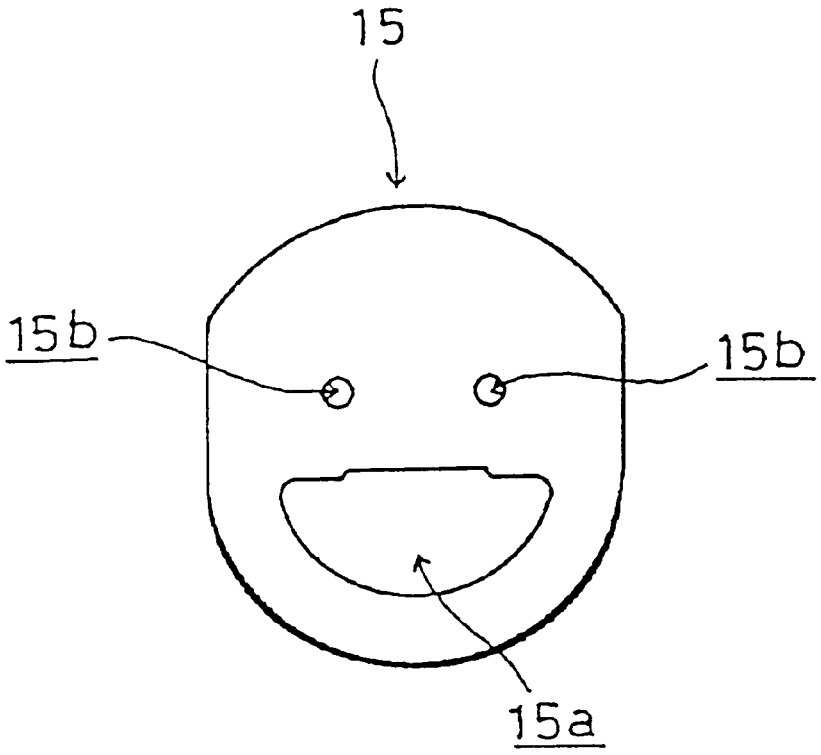
FIG. 8 is a front elevation of a choke valve body.

The choke valve body 15 is a thin stainless steel plate, and as shown in FIG. 8 is in the shape of a rectangle having top and bottom sides made into an arc. The choke valve body 15 has a shape corresponding substantially to the cross sectional shape of the intake passageway 2. A substantially semicircular relief opening 15*a* is formed in the lower half, and a pair of small holes 15*b*, 15*b* are drilled side by side in the upper half.

Figure 9:
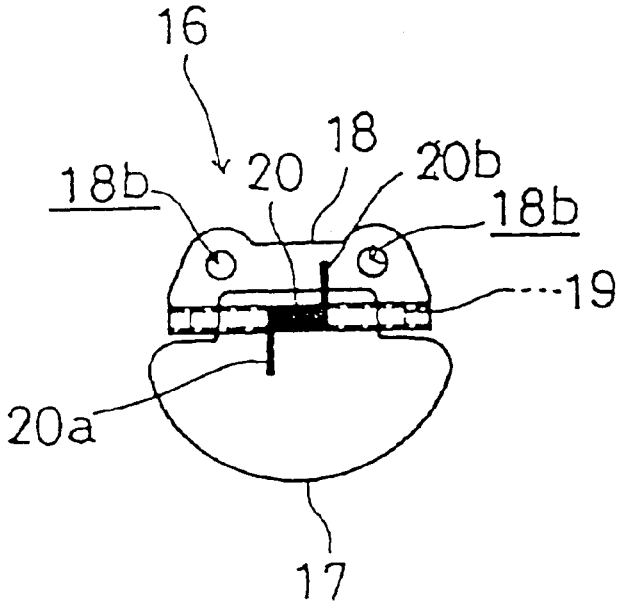
FIG. 9 is a front elevation of a relief valve.
Figure 10:
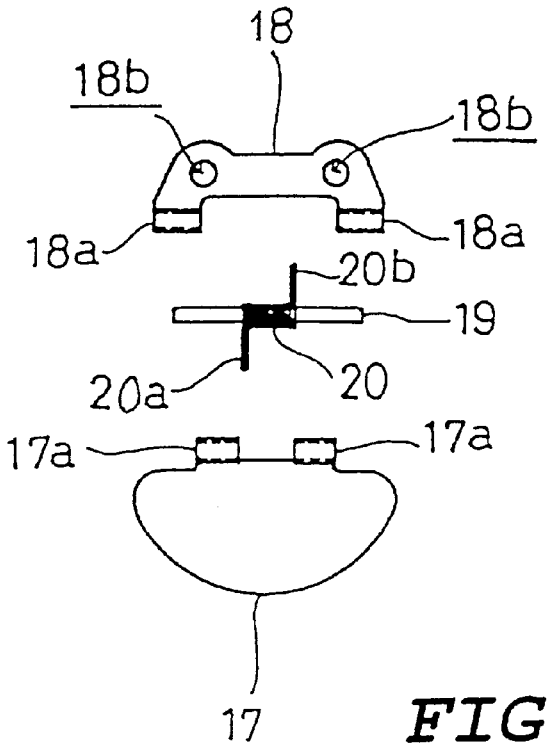
FIG. 10 is an exploded front elevation of a relief valve.

As shown in FIG. 9 and FIG. 10, a relief valve 16 for opening and closing the relief opening 15*a* of the choke valve body 15 has a hinged structure. A 15 relief valve body 17, which is a thin stainless steel plate, and a base end sideplate section 18 are interlocked via a pin 19.

The relief valve body 17 has a substantially semicircular shape, and has a pair of small coaxial circular tubes 17*a*, 17*a* formed on one edge, constituting pin holes. On the other side, the base end side plate 18 has a substantially inverted U-shape when viewed from the front in the drawing. A pair of small coaxial circular tubes 18*a*, 18*a* constituting pin holes are formed on both ends of the "U". The base end side plate 18 also has small holes 18*b*, 18*b* drilled in the lateral portion thereof.

The relief valve body 17 and the base end side plate 18 are interlocked by lining up each of the small tubes 17*a*, 18*a*, and inserting the pin 19. At the same time, a relief spring 20, in the form of a torsion coil spring, is wound around the central part of the pin 19. The two ends 20*a*, 20*b* of the relief spring extend along the surface of the relief valve body 17 and the base end side plate 18 respectively. This forms a hinge structure, with the relief valve body 17 being urged to rotate in a single rotational direction relative to the base end side plate 18.

In this way, the relief valve 16, comprising the pre-assembled hinged structure, and the choke valve body 15 can be fixed together to the choke shaft 11 using screws 21.

That is, the choke valve body 15 is locked into the flattened portion 11*a* of the choke shaft 11, the relief valve 16 is laid over the choke valve body 15, each of the small holes 15*b* and 18*b* are aligned with the screw holes 11*b*, and screws 21 are screwed in from the relief valve 16 side (refer to FIG. 6) to fasten the relief valve 16 and the base end side plate 18 together by fitting the choke valve body 15 into the choke shaft 11.

As described above, since the relief valve 16 comprising the hinged structure is fastened together with the choke valve body 15 to the choke shaft 11, the number of components and the number of assembly steps is reduced, and the assembly operation is made extremely simple.

Because the choke valve body 15 and the relief valve 16 are made of stainless steel thin plates, and the number of components is reduced, the whole of the choke valve 10 is light in weight even though it is provided with the relief valve 16.

Figure 4:
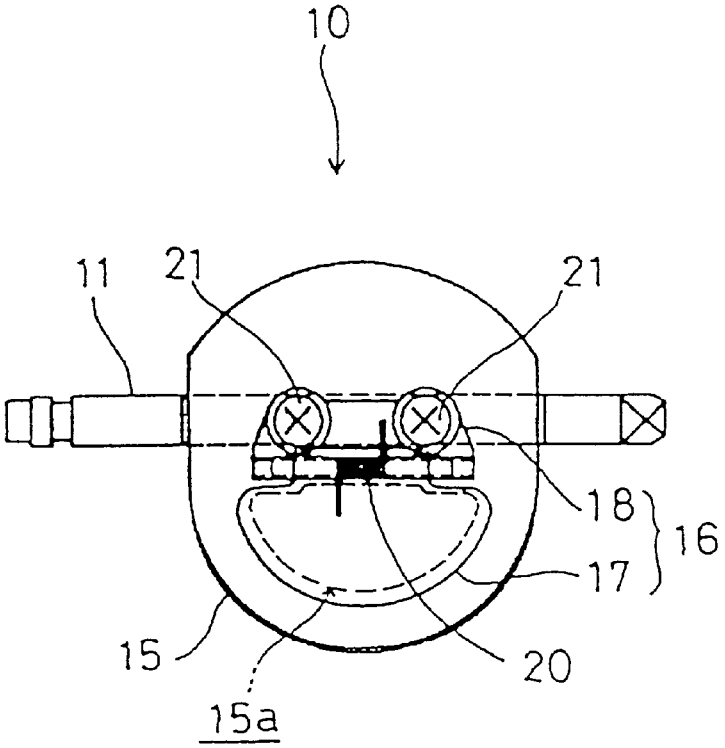
FIG. 4 is a front elevation of a choke valve.
Figure 5:
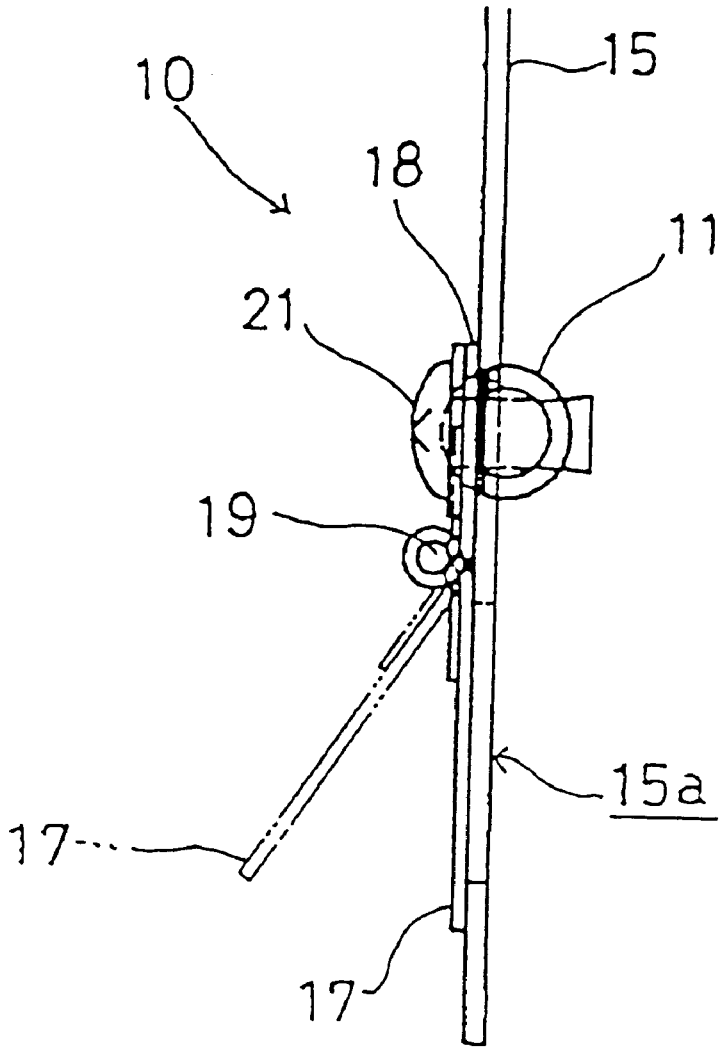
FIG. 5 is a side elevation of a choke valve.
Figure 6:
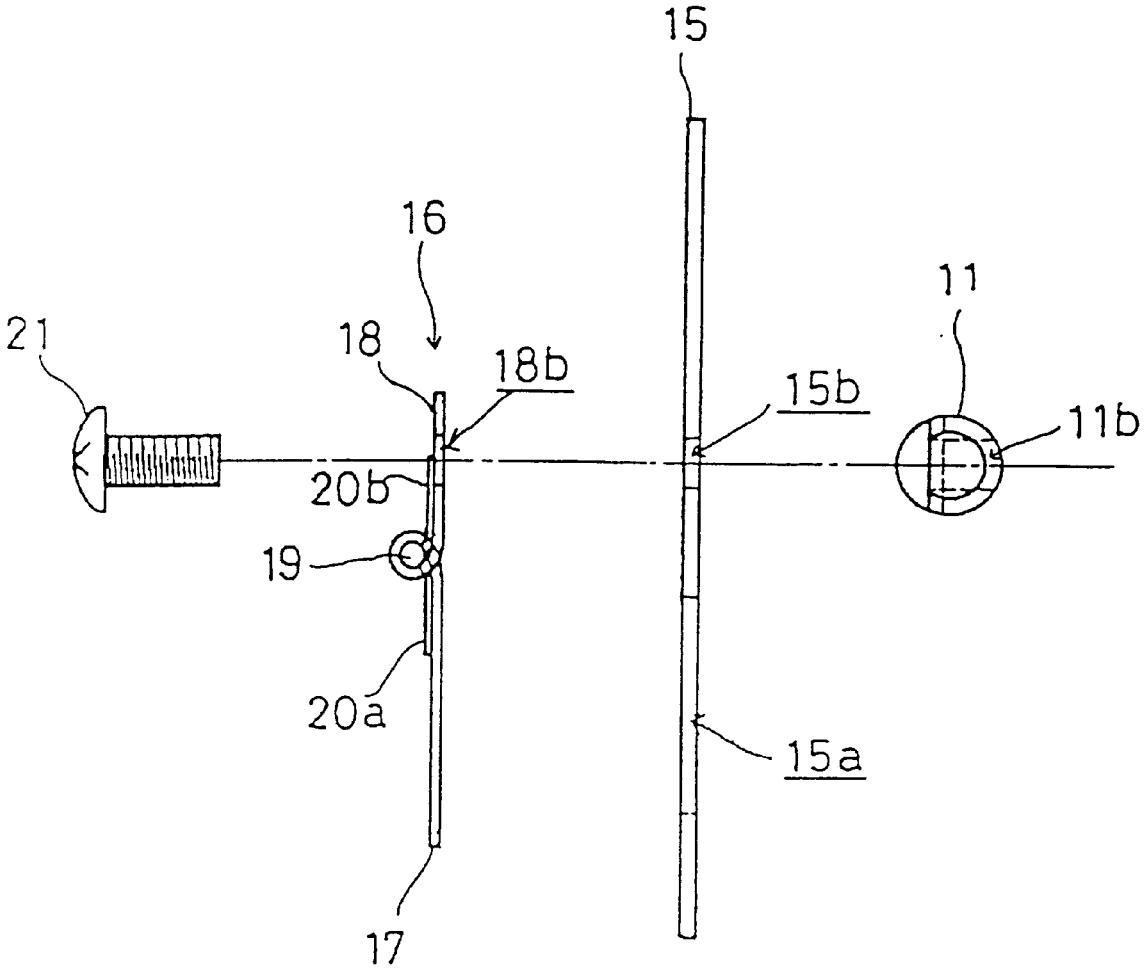
FIG. 6 is an exploded side elevation of a choke valve.

If the choke valve 10 is assembled in this way, the choke valve body 15 and the relief valve 16 are attached to the choke shaft 11 as shown in FIG. 4 and FIG. 5. The relief valve body 17, urged by the relief spring 20, closes the relief opening 15*a* of the choke valve body 15.

Accordingly, if suitable pressure is applied from the relief opening 15*a* side, the relief opening 15*a* can be opened by the relief valve body 17 swinging against the force of the relief spring 20, as shown by the two-dot-dashed line in FIG. 5.

When the relief valve body 17 swings, the relief spring 20 has abrasion resistance and the contact surfaces are not damaged, because the two ends 20*a* and 20*b* of the relief spring 20 are respectively received along the surfaces of the relief valve body 17 and the base end side plate 18.

Both ends of the choke shaft 11 are rotatably supported by bearing boss sections 2*a*, 2*a* and the choke valve 10 is supported across the inside of the intake passageway 2 so that the relief valve 16 is at an upstream side compared to the relief valve body 17.

Referring to FIG. 2, projecting stoppers 8 are oriented in a direction of flow to each downstream side of a lateral inner surface of the intake passageway 2. The projecting stoppers 8 are for pivotally supporting the choke shaft 11 and are formed at laterally symmetrical positions inside the intake passageway 2.

When the operating lever 7 is swung downwards as shown by the solid lines in FIG. 1, the protrusion 7*a* raises the choke lever 13. At this time, the choke valve 10 is at a substantially horizontal attitude in a fully open state with the choke valve body 15 pressed against the stoppers 8, as shown by solid lines in FIG. 2.

Figure 11:
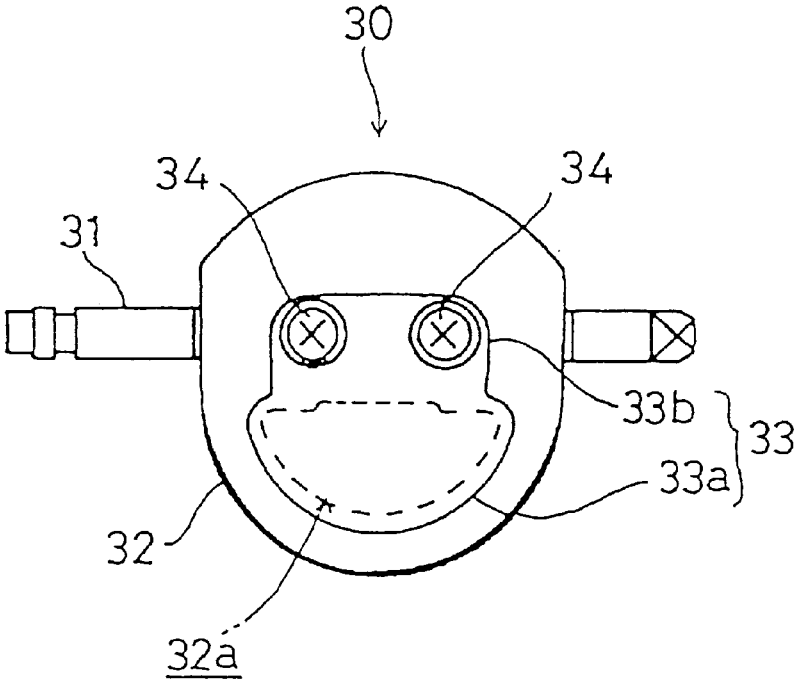
FIG. 11 is a front elevation of a choke valve to which another embodiment relates.

If the operating lever 7 is then swung upwards, the choke lever 13 that is engaged with the protrusion 7*a* swings downwards under the force of the torsion coil spring 12 (refer to the two-dot-dashed lines in FIG. 11. The choke valve body 15 rotates together with the relief valve 16 via the choke shaft 11 and the intake passageway 2 is closed, as shown by the two-dot-dashed line in FIG. 2.

Accordingly, if the operating lever 7 is moved to the state where the throttle valve 3 is suitably opened at the time of starting the internal combustion engine, the choke valve 10 closes the intake passageway 2 and a large quantity of fuel is sucked in due to negative intake pressure arising at the downstream side. Therefore, initial combustion can be carried out with a rich fuel mixture.

After that, if combustion is continued the rotational speed increases and at this time, because of the negative intake pressure the choke valve 10 opens and closes the intake passageway 2 by the choke valve body 15 swinging against the relief spring 20 together with the relief valve 16, and the mixture is automatically diluted by varying an intake flow amount.

Since the choke valve 10 having the relief valve 16 can be made lightweight, it can open and close smoothly due to negative intake pressure. Therefore, it is possible to restrict abrasion of a seat surface where the choke valve body 15 comes into contact with an inner surface of the intake passageway 2.

The relief valve 16 is then at the upstream side relative to the choke valve body 15, and the relief opening 15*a* can be opened by the relief valve body 17 swinging in the reverse direction to the direction in which the negative intake pressure is acting.

Accordingly, even when pressure acts on the choke valve 10 so as to cause the choke valve 10 to be blown back to the upstream side of the intake passageway 2, pressure opening the relief opening 15*a* can be released by the pressure acting on the relief valve body 17 from the relief opening 15*a* swinging the relief valve body 17 to the upstream side. Therefore, force applied to the choke valve body 15 is mitigated, and abrasion of a seat surface can be significantly reduced by avoiding the choke valve body 15 colliding with the inner surface of the intake passageway 2.

Since the choke valve 10 has a base end side plate 18 attached to the choke shaft 11 together with the choke valve body 15, the relief opening 15*a* can be formed wide enough to approach the choke shaft 11 which is the rotational axis of the choke valve 10, as shown in FIG. 4 and FIG. 5. Therefore, the relief function can be improved by ensuring a large relief passage.

In the above described embodiment, the choke valve 10 comprising the hinged structure is fastened to the choke shaft 11 together with the choke valve body 15. If the relief valve has a pre-hinged structure, an increase in the number of components is only slight, weight decrease is maintained and assembly is easy, even if a base end side plate of the relief valve is attached to either the choke valve body or the choke shaft.

Figure 12:
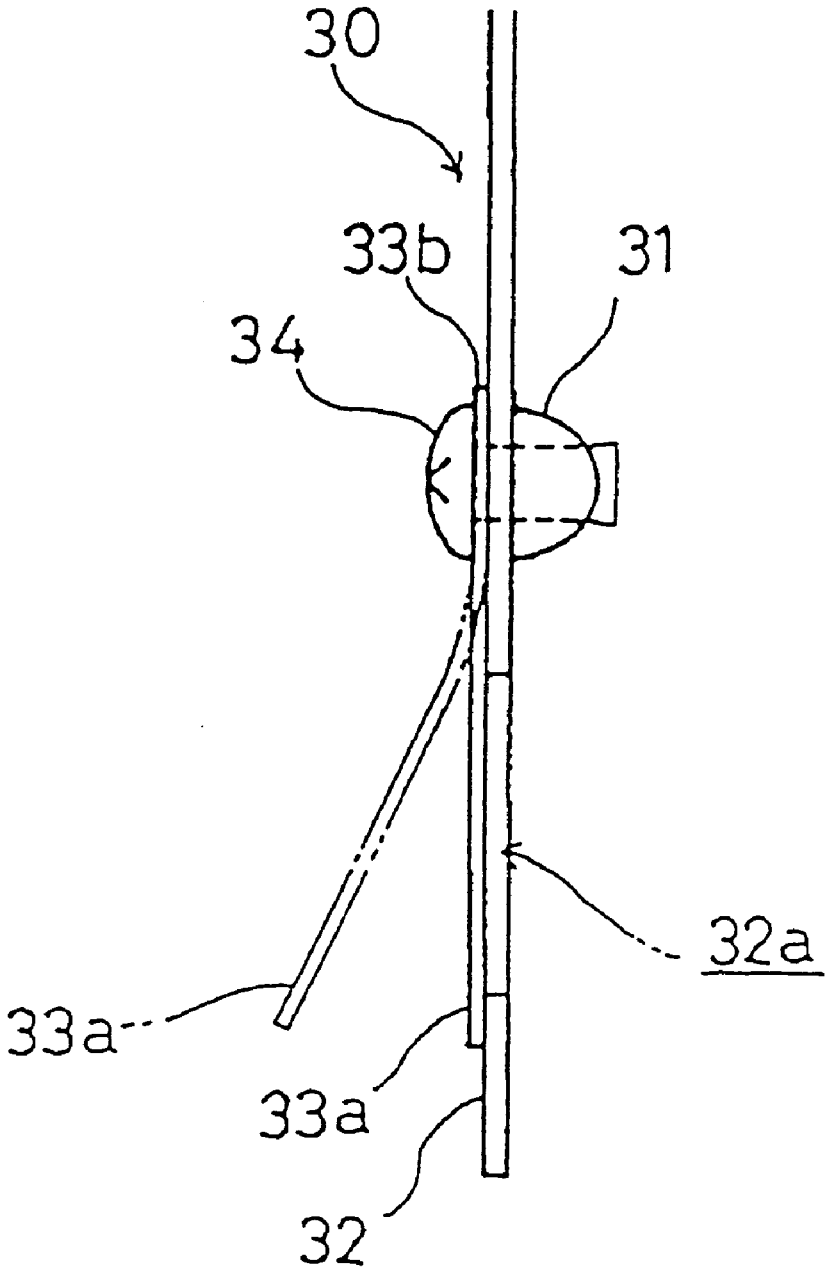
FIG. 12 is a side elevation of a choke valve to which the other embodiment relates.

Next, another embodiment of the present invention will be described with reference to FIGS. 11–13. The choke valve 30 of this embodiment uses a choke shaft 31 and a choke valve body 32 having the shape and material as the choke valve 11 and choke valve body 15 of the above described embodiment, but the relief valve 33 is different only in that it is a thin plate and elastic stainless steel plate.

Specifically, the relief valve 33 is a single thin plate comprising a lower half that is a semicircular free end side valve body 33*a* and an upper half that is a rectangular base end side plate 33*b*. There is a pair of left and right small holes in the base end side plate 33*b*.

Figure 13:
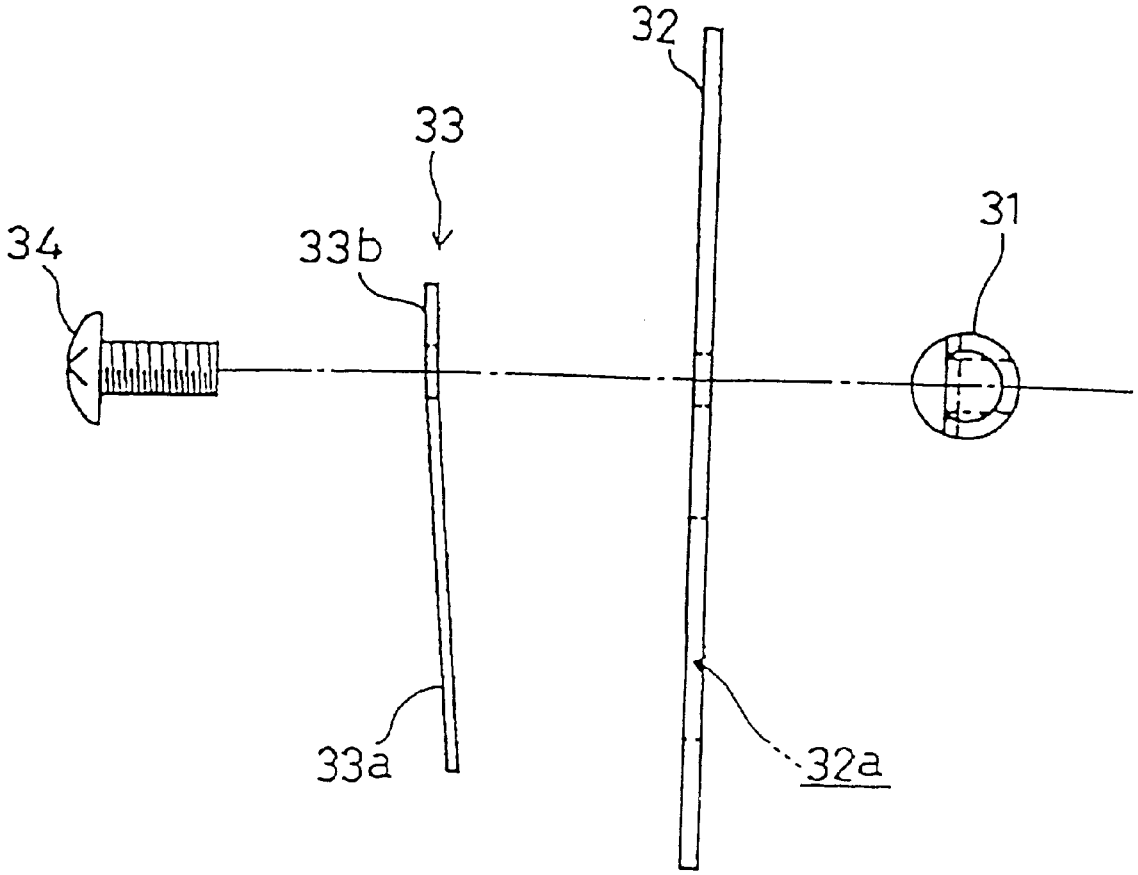
FIG. 13 is an exploded side elevation of a choke valve to which another embodiment relates.
Figure 14:
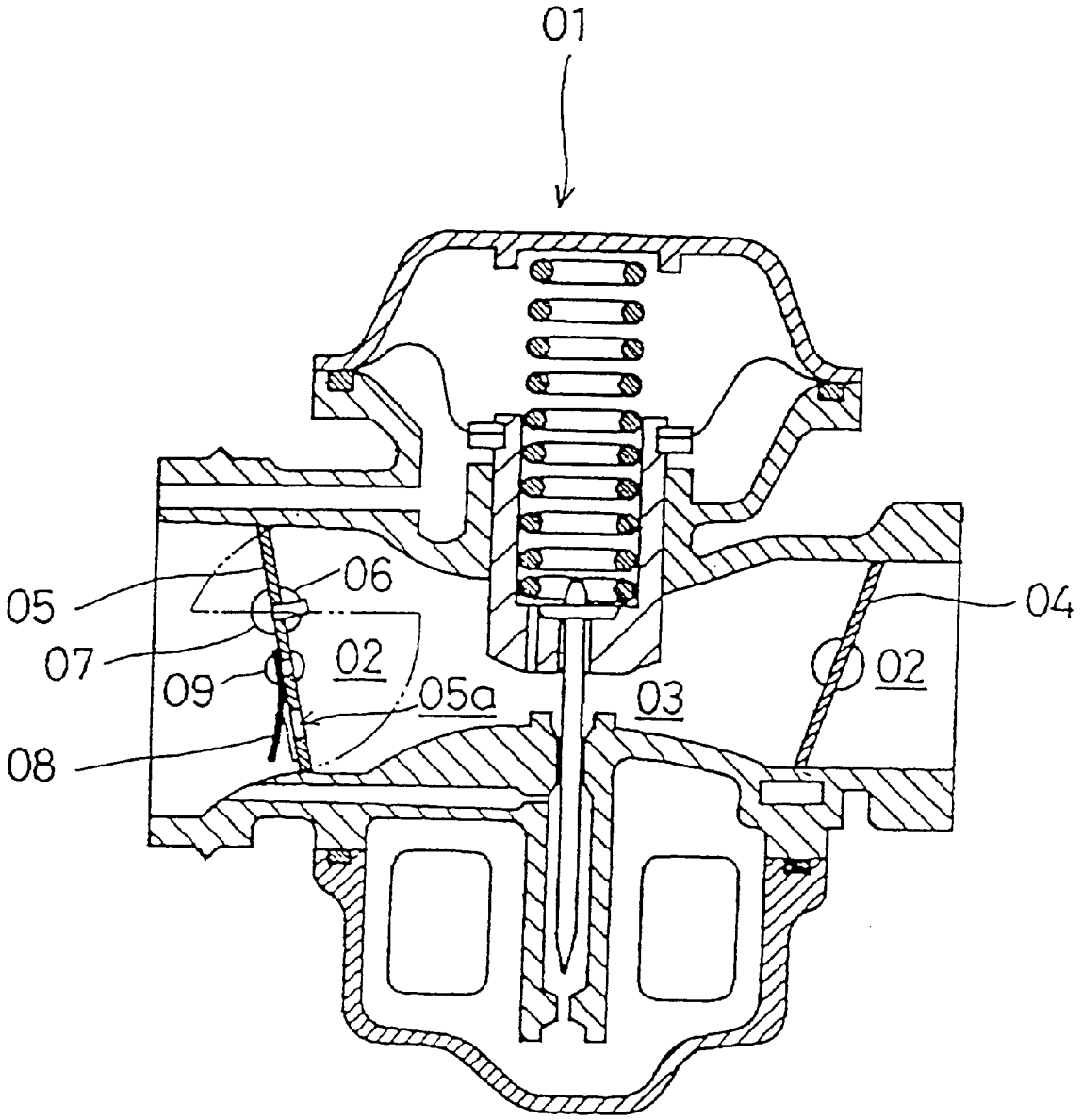
FIG. 14 BACKGROUND ART
FIG. 14 is a cross sectional drawing of a carburetor of the related art.

The relief valve 33 has such a shape that it is bent slightly toward the choke valve body 32 side hanging from the base end side plate 33*b* to the free end valve body 33*a*, when in a state with no external force applied, as shown in FIG. 13.

The choke valve body 32 is fitted into a flattened part of the choke shaft 31, a relief valve 33 is stacked on the choke valve body 32, each small hole is aligned with a screw hole and screws 34 are screwed in from the relief valve 33 side (refer to FIG. 13). The choke valve body 32 is slotted into the choke shaft 31, and the base end side plate 33*b* of the relief valve 33 is fastened together with the choke shaft 31 (refer to FIG. 11 and FIG. 12).

If the relief valve 33 is stacked on the choke valve body 32 and the base end side plate 33*b* attached, the slightly bent portion is elastically deformed and urged to come into contact with the flat surface of the choke valve body 32. Furthermore, the relief opening 32*a* of the relief valve body 32 is covered.

Since relief valve 33 is fastened to the choke shaft 31 together with the choke valve body 32, the number of components and the number of assembly steps is reduced, and the assembly process is made extremely simple.

The relief valve 33 is comprised simply of a stainless steel thin plate, the number of components is further reduced, and the choke valve 30 can be made very lightweight overall.

If the choke valve 30 is provided in the intake passageway of a carburetor similarly to the above described embodiment, at the time of starting the internal combustion engine, the choke valve 30 closes the intake passageway 2, and initial combustion can be carried out with a rich fuel mixture. After that, if combustion is continued and the rotational speed of the engine increases, the intake passageway will be opened and closed by the choke valve 30 itself swinging due to the resulting negative intake pressure, and the mixture will be automatically diluted by varying the intake flow amount.

When pressure acts on the choke valve 30 so as to cause it to be blown back to the upstream side of the intake passageway 2, that pressure causes elastic deformation of the relief valve 33, and the free end side valve body 33*a* swings to the upstream side. Therefore, pressure opening the relief opening 32*a* can be released. This means that force applied to the choke valve body 15 is mitigated, and abrasion of a seat surface where the choke valve body 15 comes into contact with the inner surface of the intake passageway 2 can be significantly reduced.

The relief valve 33 has the base end sideplate 33*b* fastened to the choke shaft 31 together with the choke valve body 32. Therefore, the relief opening 32*a* can be formed sufficiently wide so that it approaches the choke shaft 31 which is a rotational axis of the choke valve 30, as shown in FIG. 11 and FIG. 12. Therefore, the relief function can be improved by ensuring a large relief passage.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

I claim:

1. A carburetor choke valve provided in an intake passageway of a carburetor, comprising:

a plate shaped choke valve body;

a relief opening formed in the choke valve body;

a plate shaped relief valve for opening and closing said relief opening, said relief valve having a base end sideplate section;

a choke shaft for rotatably mounting the base end sideplate section of the relief valve and the choke valve body crossing the intake passage of the carburetor;

a free end side valve body hinged to the base end sideplate section together by a hinge structure;

a relief spring for energizing the free end side valve body in one rotational direction; and said relief valve is fastened to said choke shaft with the choke valve body between the base end sideplate section of said relief valve and said choke shaft.

2. The carburetor choke valve according to claim 1, wherein the base end sideplate section of the relief valve includes a plurality of holes for attaching the relief valve to the choke shaft and a plurality of tubes for attaching the base end sideplate section to the free end side valve body.

3. The carburetor choke valve according to claim 2, wherein the free end side valve body includes a plurality of tubes, the tubes of the free end side valve body and the tubes of the base end sideplate section receiving a hinge pin, the free end side valve body being pivotable about the hinge pin to open and close the relief opening of the choke valve body.

4. The carburetor choke valve according to claim 1, wherein ends of said relief spring are extended along the base end sideplate section and a surface of the free end side valve body.

5. The carburetor choke valve according to claim 4, wherein the relief spring is a torsion spring.

6. The carburetor choke valve according to claim 1, wherein the base end sideplate section and the choke valve body include a plurality of mutually aligned holes for mounting the relief valve and the choke valve body to the choke shaft.

7. A carburetor choke valve provided in an intake passage of a carburetor, comprising:

a choke valve body having at least one relief opening formed therein;

a choke shaft; and a relief valve for opening and closing said at least one relief opening in the choke valve body, said relief valve comprising:

a free end side valve body;

a base end sideplate section hinged to the free end side valve body by a hinge structure energized in one rotational direction by a relief spring; and wherein the base end sideplate section of said relief valve is attached to said choke valve body or said choke shaft.

8. The carburetor choke valve according to claim 7, wherein said relief valve is fastened to said choke shaft with the choke valve body between the base end sideplate section of said relief valve and said choke shaft.

9. The carburetor choke valve according to claim 8, wherein the base end sideplate section of the relief valve includes a plurality of holes for attaching the relief valve to the choke shaft and a plurality of tubes for attaching the base end sideplate section to the free end side valve body.

10. The carburetor choke valve according to claim 9, wherein the free end side valve body includes a plurality of tubes, the tubes of the free end side valve body and the tubes of the base end sideplate section receiving a hinge pin, the free end side valve body being pivotable about the hinge pin to open and close the at least one relief opening of the choke valve body.

11. The carburetor choke valve according to claim 7, wherein ends of said relief spring are extended along the base end sideplate section and a surface of the free end side valve body.

12. The carburetor choke valve according to claim 11, wherein the relief spring is a torsion spring.

13. The carburetor choke valve according to claim 7, wherein the base end sideplate section and the choke valve body include a plurality of mutually aligned holes for mounting the relief valve and the choke valve body to the choke shaft.

14. A carburetor choke valve comprising:

a choke valve body having at least one relief opening formed therein;

a choke shaft for rotatably mounting the choke valve body; and a relief valve for opening and closing the at least one relief opening of the choke valve body, said relief valve including a first plate member attached to the choke shaft and a second plate member hingedly attached to the first plate member.

15. The carburetor choke valve according to claim 14, wherein said relief valve is fastened to said choke shaft with the choke valve body between said first plate member of said relief valve and said choke shaft.

16. The carburetor choke valve according to claim 14, further comprising a relief spring for energizing said second plate member in one rotational direction.

17. The carburetor choke valve according to claim 14, wherein said first plate member includes a plurality of holes for attaching the relief valve to the choke shaft and a plurality of tubes for attaching the second plate member to the first plate member.

18. The carburetor choke valve according to claim 17, wherein said second plate member includes a plurality of tubes, the tubes of said first plate member and the tubes of said second plate member receiving a hinge pin, said second plate member being pivotable about the hinge pin to open and close the relief opening of the choke valve body.

19. The carburetor choke valve according to claim 16, wherein ends of said relief spring are extended along said first plate member and a surface of said second plate member.

20. The carburetor choke valve according to claim 19, wherein said relief spring is a torsion spring.

21. The carburetor choke valve according to claim 14, wherein said first plate member and the choke valve body include a plurality of mutually aligned holes for mounting the relief valve and the choke valve body to the choke shaft.

* * * * *